US008977174B2

(12) United States Patent
Falvo et al.

(10) Patent No.: US 8,977,174 B2
(45) Date of Patent: Mar. 10, 2015

(54) APPARATUS, METHOD AND SYSTEM FOR CONTROLLING STRIP RADIUS IN A PRINTING SYSTEM

(75) Inventors: John R. Falvo, Ontario, NY (US); Eliud Robles Flores, Webster, NY (US); Charles H. Tabb, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 393 days.

(21) Appl. No.: 13/517,507

(22) Filed: Jun. 13, 2012

(65) Prior Publication Data

US 2013/0336684 A1 Dec. 19, 2013

(51) Int. Cl.
*G03G 15/20* (2006.01)

(52) U.S. Cl.
USPC ..... 399/323

(58) Field of Classification Search
CPC ..... G03G 15/2028; G03G 15/2085
USPC ..... 399/323
See application file for complete search history.

(56) References Cited

U.S. PATENT DOCUMENTS 7,471,922 B2 12/2008 Robles-Flores et al.
7,529,512 B2 5/2009 Adams et al.

FOREIGN PATENT DOCUMENTS

JP 05027602 A * 2/1993
JP 2005215601 A * 8/2005

OTHER PUBLICATIONS

Ishibe et al. (JP 2005-215601 A), Aug. 2005, JPO Computer Translation.*
Falvo et al.; U.S. Appl. No. 13/046,981, filed Mar. 14, 2011; "Method for Assessing Transfer Pressure Uniformity".
Montfort et al.; U.S. Appl. No. 13/103,244, filed May 9, 2011; "Constrained Transfer Assist Blade (CTAB) for Improved Print to Edge Performance".

* cited by examiner

*Primary Examiner* — Erika J Villaluna
(74) *Attorney, Agent, or Firm* — Ronald E. Prass, Jr.; PRASS LLP

(57) ABSTRACT

An apparatus, system and method are provided for controlling one or more strip radii in a fuser. The fuser has a first member having a first surface. The fuser also has a belt having a first portion that contacts the first surface of the first member. The fuser further has a second member having a second surface that contacts a second portion of the belt in a region defining a nip. The fuser additionally has a stripping apparatus, positioned downstream of the nip in a process direction, comprising one or more adjustable blades configured to selectively exert one or more variable predetermined pressures on one or more selected sections of the first portion of the belt causing one or more selectable strip radii.

13 Claims, 7 Drawing Sheets

APPARATUS, METHOD AND SYSTEM FOR CONTROLLING STRIP RADIUS IN A PRINTING SYSTEM

FIELD OF DISCLOSURE

The disclosure relates to belt-roll fuser apparatuses, methods and systems useful in printing. Specifically, the disclosure relates to a belt-roll fuser that controls one or more strip radii by way of a stripping mechanism.

BACKGROUND

Conventional belt-roll fusers include an internal pressure roll ("IPR"), which entrains a fuser belt, and an external pressure roll ("EPR"). A fusing nip is conventionally defined by a region under pressure between the EPR and the IPR. Conventional belt-roll fusers utilize a hard IPR and a soft EPR to form a fusing nip for fusing an image to a substrate that has just received toner from a transfer station. See FIG. 1 for an example of a related art belt-roll fuser architecture.

Conventional belt-roll fusers often have a stripping shoe that is used to load an inner side of the fuser belt to generate an effective fusing nip pressure, and cause the substrate to strip from the fuser belt. While the stripping shoe may help generate an effective fusing nip pressure, and cause the substrate to strip from the fuser belt, belt-roll fusers that utilize a conventional stripping shoe still often face image related defects such as, but not limited to, gloss related image quality ("IQ") defects, mottle, stripping performance, and failure to demonstrate process latitude. These issues may be caused by any number of issues, including, but not limited to, failure to optimially strip the substrate from the fuser belt and/or a variance in the strip point due to a variance in image content, media size, media coating, media weight, media thickness, media stiffness, process speed, process conditions, etc.

SUMMARY

Apparatuses, methods and systems for use in printing are disclosed. Various exemplary embodiments improve image quality performance of belt-roll fusers by selectively controlling one or more selectable strip radii by way of a stripping mechanism.

According to one embodiment, an apparatus useful in printing comprises a first member having a first surface. The apparatus further comprises a belt having a first portion that contacts the first surface of the first member. The apparatus also comprises a second member having a second surface that contacts a second portion of the belt in a region defining a nip. The apparatus additionally comprises a stripping apparatus, positioned downstream of the nip in a process direction, comprising one or more adjustable blades configured to selectively exert one or more predetermined pressures on one or more selected sections of the first portion of the belt to cause one or more selectable strip radii.

According to another embodiment, a method for stripping a substrate from a fuser belt comprises defining a nip in an apparatus useful in printing. The apparatus comprises a first member having a first surface. The apparatus further comprises a belt having a first portion that contacts the first surface of the first member. The apparatus also comprises a second member having a second surface that contacts a second portion of the belt in a region defining a nip. The apparatus additionally comprises a stripping apparatus, positioned downstream of the nip in a process direction, comprising one or more adjustable blades configured to selectively exert one or more predetermined pressures on one or more selected sections of the first portion of the belt to cause one or more selectable strip radii. The method further comprises causing, at least in part, the one or more selectable strip radii. The method also comprises causing, at least in part, stripping of the substrate from the belt.

According to another embodiment, a system useful in printing configured to strip a substrate comprises a first member having a first surface. The system also comprises a belt having a first portion that contacts the first surface of the first member. The system further comprises a second member having a second surface that contacts a second portion of the belt in a region defining a nip. The system also comprises a stripping apparatus, positioned downstream of the nip in a process direction, comprising one or more adjustable blades configured to selectively exert one or more variable predetermined pressures on one or more selected sections of the first portion of the belt causing one or more selectable strip radii. The substrate, according to the system, is stripped from the belt at a position downstream of the nip in the process direction.

Exemplary embodiments are described herein. It is envisioned, however, that any system that incorporates features of any apparatus, method and/or system described herein are encompassed by the scope and spirit of the exemplary embodiments.

DETAILED DESCRIPTION

Figure 1:
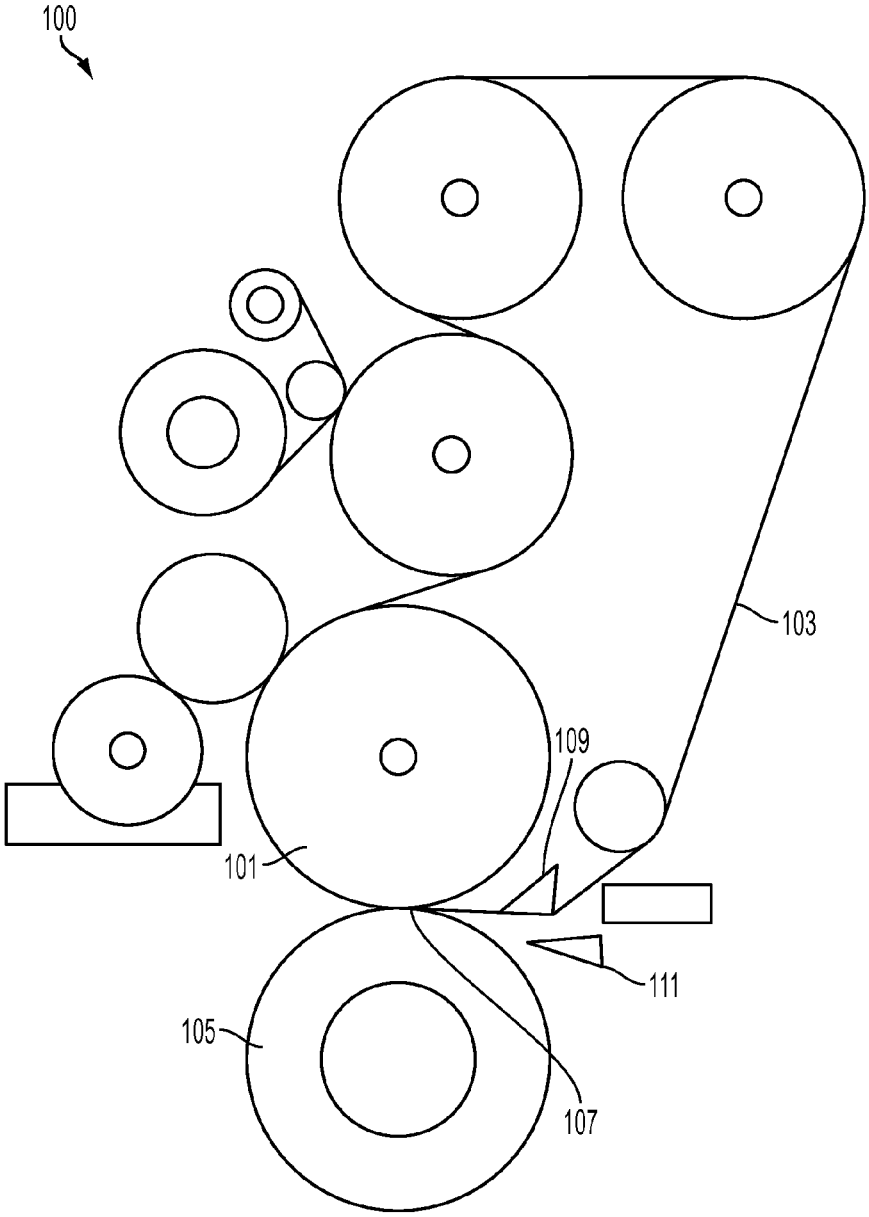
FIG. 1 RELATED ART
FIG. 1 is a diagrammatical side view of a related art belt-roll fuser.

Exemplary embodiments are intended to cover all alternatives, modifications and equivalents as may be included within the spirit and scope of the apparatuses, methods and systems as described herein.

Reference is made to the drawings to accommodate understanding of disclosed apparatuses, methods and systems useful in printing. In the drawings, like reference numerals are used throughout to designate similar or identical elements. The drawings depict various embodiments related to embodiments of illustrative apparatuses, methods and systems for selectively controlling one or more strip radii by way of a stripping mechanism to cause effective stripping.

As used herein, the term "strip radius" or any variants thereof refers to a curvature of a fusing belt at a point at which one or more media substrates on which an image is printed and/or fused is stripped or removed from the fuser belt after the image is printed and/or fused to the media substrate.

As used herein, the term "media geometry" refers to a media size and/or thickness.

As used herein, the term "belt geometry" refers to a belt size and/or thickness.

As used herein, the term "image type" refers to a definition of a type of image such as, but not limited to, photo, text, color image, black and white image, artist rendering, computer rendering, etc.

As used herein, the term "image location" refers to the position of a print image on a media substrate. That is determining whether the image is centered on the substrate, determining margins, around the image, etc.

As used herein, the term "process speed" refers to a speed at which a printing system prints images and/or feeds media through the system. For example, a process speed may refer to sheets per minute, RPM's of a fuser belt, RPM's of one or more rollers that are part of the print system, etc.

As used herein, the term "process timing" refers to a moment in time at which a task is performed during a printing process associated with a position on the media substrate such as a lead edge, trailing edge, center portion, image starting portion in a process direction, image ending portion in a process direction, etc. Such tasks may include, but not be limited to, for example, stripping the media from a belt, initiating a change in strip radius at a moment a specific portion of the media passes a point in the printer system associated with a designated task (e.g., stripping, printing, blowing air, exerting pressure, changing pressure, fusing, expelling ink or toner, etc.) during a printing process, etc.

Apparatuses and systems of embodiments may include systems for printing images on media by fusing marking material to a substrate using a belt-roll fuser.

FIG. 1 illustrates a diagrammatical side view of an example related art belt-roll fuser 100. Conventional belt-roll fusers utilize a hard IPR 101, which entrains a fuser belt 103, and a soft EPR 105. The IPR 101, fuser belt 103 and EPR 105 form a fusing nip 107 for fusing an image to a substrate that has just received toner from a transfer station. Alternatively, belt-roll fuser 100 may utilize any combination of pressure members such as any combination of pressure belts and/or arrangement of hard and soft rolls. For simplicity, following discussion will be related to a dual-roll fuser. But regardless of the fuser type, the same or similar issues discussed below may occur.

The substrate may be any form of media upon which marking material, such as toner, may be deposited. The substrate may be fed by the belt-roll fuser 100 through the fusing nip 107 in a process direction from a nip entrance to a nip exit. The belt-roll fuser 100 may then be configured to apply, e.g., pressure and heat at the fusing nip 107 to fuse a marking material to the substrate.

The fuser belt 103 may be entrained by one or more components of the belt-roll fuser 100. For example, the fuser belt 103 may have a first side and a second side. The first side, for example, may be an inner side that contacts the IPR 101, and may also contact other members of the belt-roll fuser 100 that may entrain the fuser belt 103. The second side may contact a substrate that passes through the fusing nip 107.

Belt-roll fusers that utilize conventional IPR and EPR architecture such as that illustrated in FIG. 1 often face image related defects such as, but not limited to, gloss related IQ defects, stripping performance, and failure to demonstrate process latitude. These issues may be due to variability in fusing nip geometry caused by variables such as IPR and/or EPR elastomer bulge, temperature variation, shoe location, and inboard to outboard nip dynamics, as well as a fixed strip shoe 109 geometry across the fuser belt 103.

To help with the aforementioned image related defects, the related art belt-roll fuser 100 illustrated in FIG. 1 uses a strip shoe 109 to load the fuser belt 103 and aid in stripping a substrate from the fuser belt 103. The belt-roll fuser 100 also uses an air knife 111 to aid in stripping the substrate from the fuser belt 103. Paper tends to stick to the fuser belt 103 after passing through the fusing nip 107. The strip shoe 109 provides a small (<5 mm) stripping radius such that the paper will peel away from the fuser belt 103.

While some strip shoes 109 may be caused to vary the stripping radius by selectively applying pressure, conventional strip shoes 109 are fixed in width across the fuser belt 103. This results in inconsistent stripping performance which may cause the above-mentioned image-related defects, as well as increased wear on the components of the belt-roll fuser 100 such as the fuser belt 103. For example, because the strip shoe 109 is fixed in width across the fuser belt 103, there is not enough process latitude to accommodate different sized media, different types of media, media of different stiffness, printing/process speeds, different process conditions, image types or locations, different belt sizes, etc. that may require or benefit from selectively variable or different strip radii across width of the fuser belt 103.

It is difficult for belt-roll fusers to simultaneously optimize both fusing and stripping functions for all media weights in apparatuses that include a pressure roll and a fuser belt 103. For example, when such fusers are operated using the same process parameters for all media weights, instead of using the optimal conditions for each different media type, light-weight media may not strip, heavy-weight media can generate differential gloss image defects or possibly excessive edge-wear in the fuser belt 103, and other image defects may occur because of inefficient stripping. Further, having a strip shoe 109 that is of a fixed geometry across the width of the fuser belt 103 may generate excessive wear of the fuser belt 103 if, for example, the entire strip shoe 109 is not needed for a smaller media size. Accordingly, the strip shoe 109 may contact a portion of the fuser belt 103 unnecessarily to create a stripping radius in an unneeded area of the fuser belt 103.

Accordingly, there is a need for a fuser system that provides reliable stripping performance by creating one or more variable stripping radii across the width of the fuser belt 103 on demand to accommodate different media types, media weights, media sizes, process conditions, image preferences, belt sizes, etc., for example.

Figure 2:
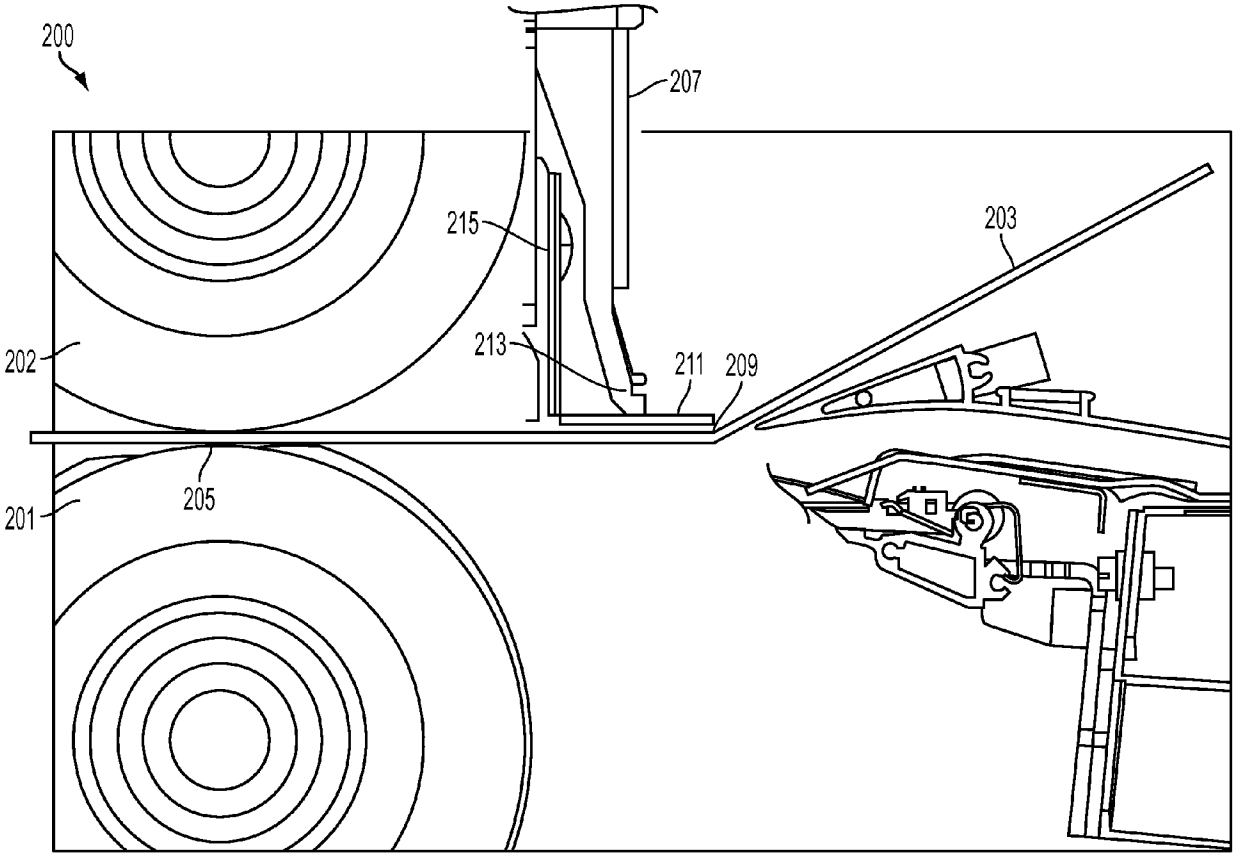
FIG. 2 is a diagrammatical side view of a belt-roll fuser having a stripping mechanism, according to one example embodiment.

FIG. 2 illustrates a diagrammatical side view of a belt-roll fuser 200 that controls one or more strip radii by way of a striping mechanism to affect image quality and stripping performance, according to one embodiment.

The belt-roll fuser 200 includes a pressure member such as roll 201 that forms a fusing nip with another pressure member such as roll 202 which entrains a fuser belt 203. Roll 201, in this example, may be a drum or roll that is rotatable about its longitudinal axis. Alternatively, the roll 201 may be replaced by a pressure belt having a backing plate, for example, to form the fusing nip with the roll 202. The roll 201 may comprise any elastomer material, rubber, polymer and/or metal. The belt-roll fuser 200 may, in alternative embodiments replace the roll 202, for example, with a series of rolls and/or support elements that entrain the fuser belt 203 to form the fusing nip with the roll 201, or any alternative features that may replace the roll 201. In other words, the belt-roll fuser 200 may be any style such as a dual-roll fuser or a dual-belt fuser, for example. Any other member may be proximate the fusing nip or not. Any other member that entrains the fuser belt 203 may comprise elastomer material, rubber, polymer, and/or metal, for example. For simplicity, the remainder of this discussion will refer, however, to a fuser having at least the roll 201.

The roll 201 and the fuser belt 203 define a fusing nip 205 in a region at which the roll 201 and the fuser belt 203 are in contact with one another. In the fusing nip 205.

According to one example embodiment, the belt-roll fuser 200 may include a stripping mechanism 207 that may be used to induce one or more selectable strip radii 209 downstream of the fusing nip 205 in a process direction. The stripping mechanism 207 may also be configured to cause one or more selectable strip radii 209 widths across the width of the fuser belt 203 to accommodate different sized media or image options, as discussed above, for example. The stripping mechanism 207 may have one or more adjustable blades 211 that may be actuated so as to press against the fuser belt 203 and variably exert one or more variable predetermined pressures. In one embodiment, there may be a singular adjustable blade 211. In alternative embodiments, there may be two or more adjustable blades 211.

In one or more embodiments, the one or more adjustable blades 211 may comprise any elastomer material, rubber, polymer and/or metal, and may be coated with a friction reducing coating such as Teflon®. In some embodiments, some or all of the adjustable blades 211 may be of the same, or different materials. For example, it may be desirable to have a blade of a certain material at position that may be used to strip a central region of a substrate as opposed to an outer region of the substrate which it may be desirable to have a blade of a different material.

In one or more embodiments, the adjustable blades 211 may be individually caused to move from an "up" position away from the fuser belt 203, to at least one "down" position against the fuser belt 203 by a linkage with one or more see-saw type fulcrum systems 213. For example, the see-saw type fulcrum systems may function by pulling up on a tail end of an adjustable blade 211 which may be attached to an extrusion 215 causing the adjustable blade 211 to pivot on a fulcrum forcing a free side of the adjustable blade to move downward in a direction toward the fuser belt 203, thereby applying pressure to the fuser belt 203. However, any other means may be implemented for forcing the one or more adjustable blades to exert one or more variable predetermined pressures onto the fuser belt 203 such as the above mentioned pivot point being a point of applied pressure from the fulcrum that may be driven into the one or more adjustable blades 211 by a motor, for example.

The movement of the adjustable blades 211 may be controlled such that the movement may be stepped or linear. In one or more embodiments, the pivot point of the fulcrum on which the adjustable blade 211 pivots may additionally be selectively varied by the belt-roll fuser to optionally vary the one or more predetermined pressures. Alternatively, all of the adjustable blades 211 may be caused to move by the stripping mechanism 207 without initiating the see-saw type fulcrum systems 213 such as by rotating the extrusion 215 configured to hold the one or more adjustable blades 211. Or, if the stripping mechanism 207 does not have any see-saw type fulcrum systems 213, the stripping mechanism 207 may cause the one or more adjustable blades 211 to move as a whole by rotating the extrusion 215.

In one or more embodiments, the one or more see-saw type fulcrum systems 213, having one or more components, and the extrusion 215 may comprise any elastomer material, rubber, polymer and/or metal. In some embodiments, some or all of the one or more see-saw type fulcrum systems 213 and the extrusion 215 may be of the same, or different materials. For example, it may be desirable to have a fulcrum system of a certain material at position that may be used to strip a central region of a substrate as opposed to an outer region of the substrate which it may be desirable to have a fulcrum system of a different material. Any differing materials may have an effect on the pressure exerted on the fuser belt 203, for example, because of a variance in hardness and/or spring constant.

The one or more variable predetermined pressures may be uniform throughout any of the actuated adjustable blades 211, may be unique to each of the actuated adjustable blades 211, or any combination thereof.

According to various environments, the one or more variable predetermined pressure may be varied by altering a degree of depression of any of the one or more adjustable blades 211. The one or more variable predetermined pressures may also be controlled based on a determination of an estimated stiffness factor based on one or more of a variance from one another in material of any of the one or more adjustable blades 211, a geometry such as a length, thickness or shape of any of the one or more adjustable blades 211, a variance in material of any component of the one or more see-saw type fulcrum systems 213, a geometry such as a length, thickness or shape of any component of the one or more see-saw type fulcrum systems 213, etc. The estimated stiffness factor may be accounted for when applying one or more variable predetermined pressures to cause one or more selectable strip radii 209. The one or more variable predetermined pressures may additionally be varied by adjusting the position of the stripping mechanism 207 as a whole.

For example, one or more variable predetermined pressures that are applied by any of the one or more adjustable blades 211 may not only be steadily exerted by the stripping mechanism 207, but they may also be caused to predictably vary based on an allowance to enable the predetermined pressure to "give" and/or an estimated stiffness factor of any of the adjustable blades 211, the see-saw type fulcrum systems 213, and/or the extrusion 215 based, at least in part, on the features discussed in the preceding paragraph. Further, the estimated stiffness factor may be considered by the belt-roll fuser 200 to determine whether to vary the degree of depression of any of the one or more adjustable blades 211 in consideration of the estimated stiffness factor to maintain a predetermined pressure throughout the stripping process, vary the degree of depression of the one or more adjustable blades 211 to allow for flexibility in the strip radii 209 during a process, or maintain a steady degree of depression to allow flexibility in strip radii 209, based on the estimated stiffness factor.

In one or more embodiments, the one or more variable predetermined pressures may be further adjusted by changing a position of the entire stripping mechanism 207 such as by moving it closer to or away from the fuser belt 203, or closer to or away from the fusing nip 205. In other words, the stripping mechanism 207 may be configured to move in any direction to further optimize stripping performance and vary any applied predetermined pressures.

According to one or more example embodiments, the stripping mechanism 207 may cause more than one strip radius 209 for various stripping needs by applying the one or more variable predetermined pressures discussed above. For example, selectable strip radii 209 may be selectively caused to change based on a determination of one or more of a media type, a media geometry, a belt geometry, an image type, an image location, a process speed, and a process timing.

For example, the one or more adjustable blades 211 may be actuated at different degrees of depression to cause different predetermined pressures across the fuser belt 203 at selected locations. Alternatively, or in addition to, one or more of the adjustable blades 211 may be preloaded against the fuser belt 203, or not, and further actuated at a lead edge of a media sheet and then not actuated at the trailing edge of the media sheet, for example. This would help tailor the stripping of the lead edge independent from the trailing edge, etc.

If heavy-weight media is used, which usually needs a lesser strip radius than a light-weight media, then a lesser predetermined pressure may be applied. More flexibility may also be allowed based on the determined stiffness factor of the various components of the stripping mechanism 207.

Further, the belt-roll fuser 200 may determine a media size. Upon determining the media size, the belt-roll fuser 200 may cause the stripping mechanism 207 to only actuate adjustable blades 211 that may correspond, and be applicable to optimally stripping, the determined media size. For example, if a fuser belt 203 has a width that is greater than the determined media size, it may be advantageous to actuate blades that correspond to the determined media size so that additional blades do not cause excessive wear on the fuser belt 203. Further, by not causing additional blades that are not necessary to be actuated, this would reduce anywhere that may occur on the one or more adjustable blades 211.

In one or more embodiments, the belt-roll fuser 200 may also be configured to determine that different strip radii may be required at an outboard and an inboard position of a substrate compared to a center area of the substrate. To accomplish this, once the media type is determined, any appropriate adjustable blades 211 are designated to be actuated, and stiffer or greater predetermined pressure may be applied at the outboard and inboard positions compared to the center area of the substrate.

In one or more embodiments, the belt-roll fuser 200 may also be configured to determine a side of the substrate and cause the predetermined pressure to adjust the strip radii 209 at any selected location across the width of the fuser belt 203 and/or process timing such as lead edge or trailing edge to cause optimal stripping performance according to stripping preferences for the determined side of the substrate. For example, if one side of the substrate has an image type or location that requires greater outboard and inboard pressure compared to another side that has as image type or location requiring lesser outboard and inboard pressure, the predetermined pressure may be adjusted to cause optimal strip radii 209 at selection locations on the substrate to provide optimal stripping performance.

In one or more embodiments, the belt-roll fuser 200 may also be configured to determine a type of fuser belt 203, or a thickness of fuser belt 203, and cause the predetermined pressure to be adjusted so as to adjust the one or more strip radii 209 at any selected location across the width of the fuser belt 203 at any process timing such as lead edge or trailing edge to cause optimal stripping performance based on the determined belt type and/or thickness.

In one or more embodiments, the belt-roll fuser 200 may also be configured to determine certain process conditions such as temperature, humidity, print speed, etc. and cause the predetermined pressure to be adjusted so as to adjust the one or more strip radii 209 at any selected location across the width of the fuser belt 203 at any process timing such as lead edge or trailing edge to cause optimal stripping performance. For example, the strip radii 209 may be adjusted at any position to account for the substrate sticking to the fuser belt 203 on account of a heightened humidity.

Figure 3:
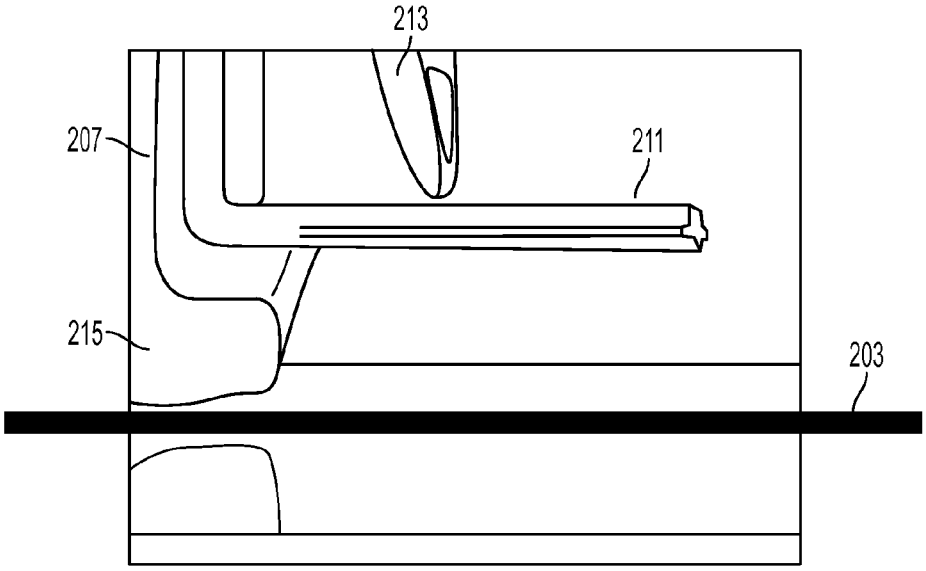
FIG. 3 is a diagrammatical side view of a stripping mechanism in a non-actuated position, according to one example embodiment.

FIG. 3 illustrates the stripping mechanism 207 in a non-actuated position. The adjustable blades 211 are in an "up" position such that they are not in contact with the fuser belt 203. The see-saw type fulcrum systems 213 are positioned such that they do not cause the adjustable blades 211 to be depressed to exert one or more variable predetermined pressures on the fuser belt 203. As discussed above, the degree of depression of any of the adjustable blades 211 may be varied to any degree by way of a series of steps or in a linear fashion. The one or more predetermined pressures may also be varied, as discussed above, by moving the stripping mechanism 207 in any direction. Additionally, the extrusion 215 may be rotated to cause one or all of the adjustable blades 211 to exert one or more predetermined pressures on the fuser belt 203.

Figure 4:
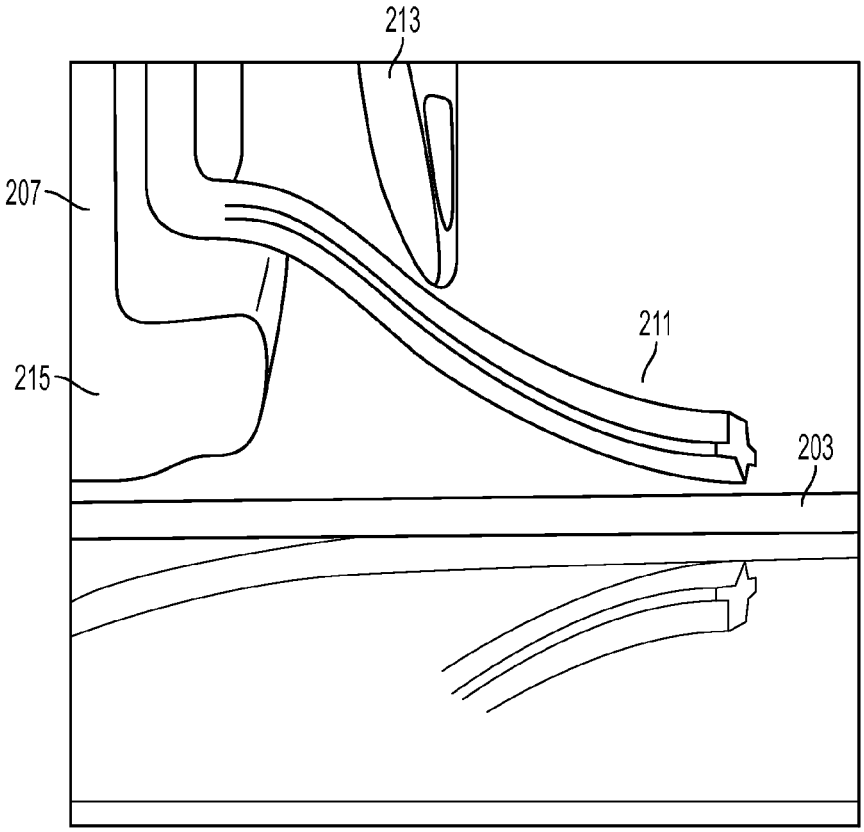
FIG. 4 is a diagrammatical side view of a stripping mechanism in an actuated position, according to one example embodiment.

FIG. 4 illustrates the stripping mechanism 207 in an actuated position. The adjustable blades 211 are in a "down" position such that they are in contact with the fuser belt 203. The see-saw type fulcrum systems 213 are positioned such that they cause the adjustable blades 211 to be depressed so as to exert one or more predetermined pressures on the fuser belt 203. As discussed above, the degree of depression of any of the adjustable blades 211 may be varied to any degree by way of a series of steps or in a linear fashion. The predetermined pressure may also be varied, as discussed above, by moving the stripping mechanism 207 in any direction. Additionally, the extrusion 215 may also be rotated to cause one or all of the adjustable blades 211 to exert a predetermined pressure on the fuser belt 203.

Figure 5:
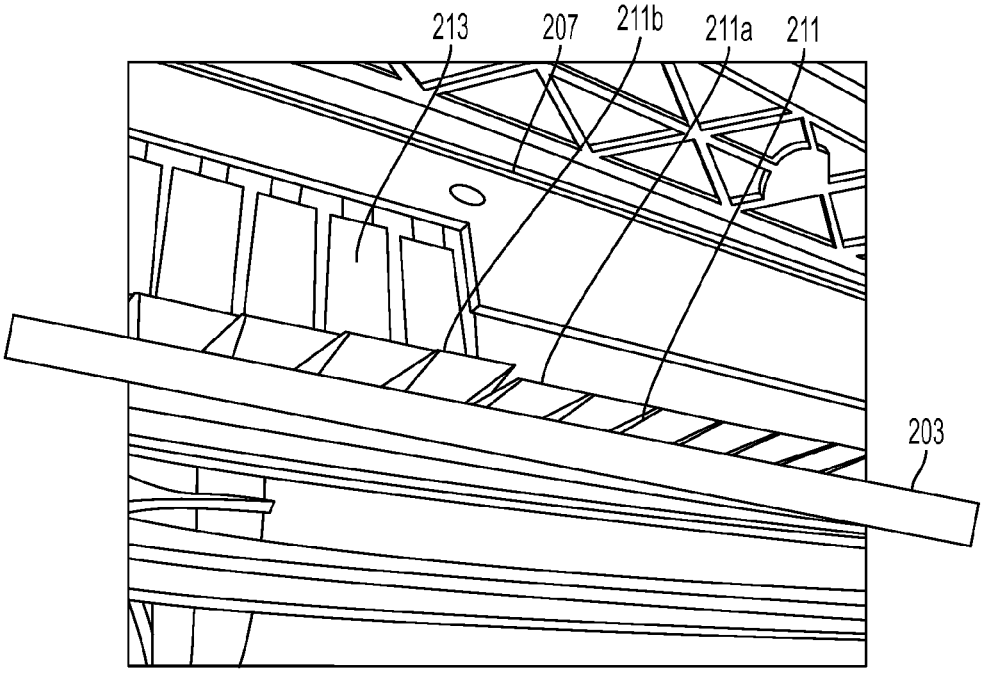
FIG. 5 is a diagrammatical perspective view of a stripping mechanism that is selectively actuated, according to one example embodiment.

FIG. 5 illustrates a perspective view of the stripping mechanism 207 having adjustable blades 211, some of which are actuated and some of which are not actuated. For example, adjustable blades 211*a* are in the "down" position depressed against fuser belt 203 so as to exert one or more predetermined pressures. But, adjustable blades 211*b* are in an "up" position such that they are not depressed against the fuser belt 203. The see-saw type fulcrum systems 213 are individually controlled to cause any selected adjustable blade 211 to be actuated or not actuated on demand.

As discussed above, the actuation of any of the adjustable blades 211 may be caused to optimize stripping performance for a combination of reasons, such as media size, media type, media thickness, media stiffness, belt size, image type, image location, print side, process speed, process conditions such as temperature and humidity, etc. Accordingly, as discussed above, the individual actuation of any of the adjustable blades 211 to cause one or more selectable strip radii 209 may occur to individually tailor the stripping performance of a print operation for a lead edge of a substrate, a trailing edge of a substrate, cause differing inboard, outboard and central pressures, or change pressures for any specific image preference, to optimize stripping performance in view of the reasons discussed above, as well as to customize various strip radii 209 so that stripping performance may be optimized in view of current print job output as viewed by an operator, for example.

Figure 6:
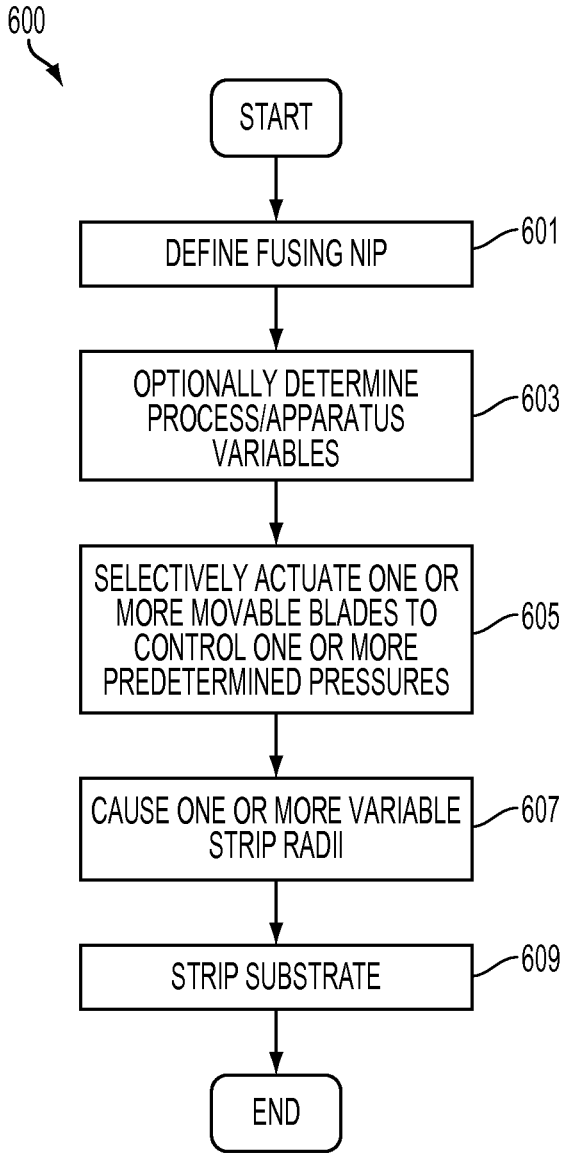
FIG. 6 is a flowchart of a process for stripping a substrate from a fuser belt, according to one example embodiment.
Figure 7:
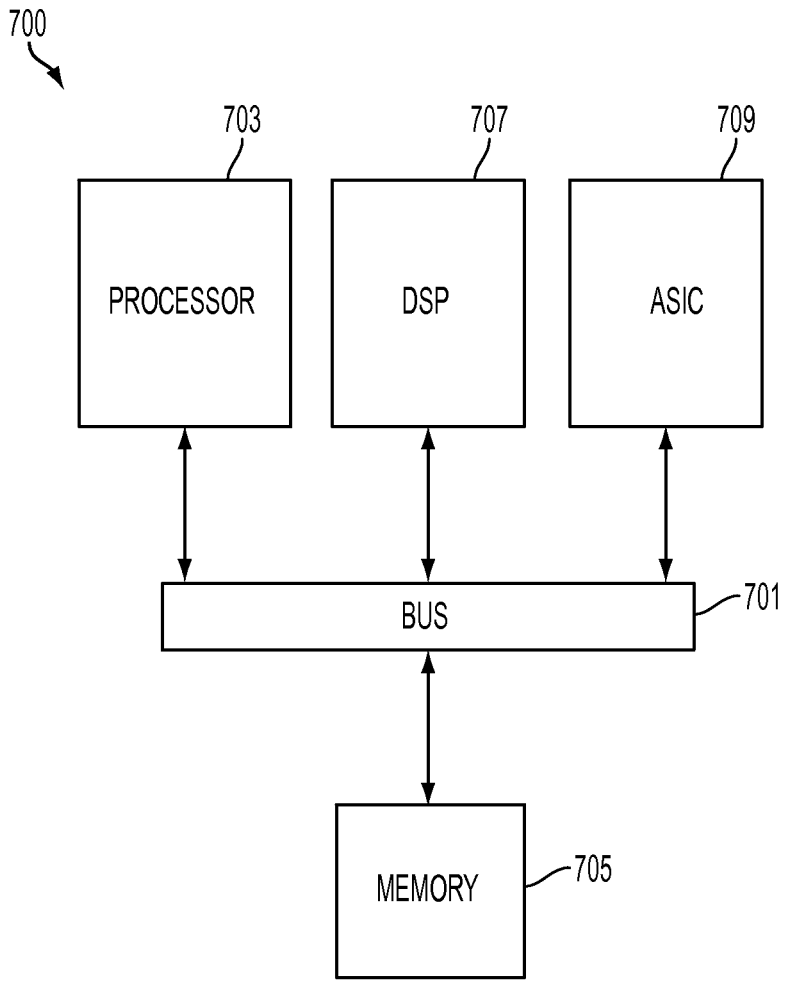
FIG. 7 is a diagram of a chip set that can be used to implement an example embodiment.

FIG. 6 is a flowchart of a process for stripping a substrate from a fuser belt 203, according to one embodiment. In one embodiment, the belt-roll fuser 200 performs the process 600 by way of a control module implemented in, for instance, a chip set including a processor and a memory as shown in FIG. 7. In step 601, the belt-roll fuser 200 defines a fusing nip 205 in the belt-roll fuser 200. The belt-roll fuser 200 may have, for example, a pressure member such as the roll 201 and a fuser belt 203 that, when under pressure define a fusing nip 205.

The process continues to step 603 in which the belt-roll fuser 200 optionally determines various process variables that may be considered for optimizing stripping performance of a substrate from the belt-roll fuser 200. For example, various process variables may include any combination of media size, media type, media thickness, media stiffness, belt size, image type, image location, print side, process speed, process conditions such as temperature and humidity, adjustable blade 211 materials/geometry, see-saw type fulcrum system 213 materials/geometry, extrusion 215 materials/geometry, etc.

Next, in step 605, the belt-roll fuser 200 optionally causes, at least in part, the stripping mechanism 207 to depress one or more adjustable blades 211 so as to exert one or more predetermined pressures on the fuser belt 203. The belt-roll fuser 200 may cause the one or more adjustable blades to move by way of the one or more see-saw type fulcrum systems 213, the extrusion 215, and/or by moving the stripping mechanism 207. The one or more predetermined pressures may be varied across the width of the fuser belt 203 to optimize stripping performance at various selected locations and process timings. The variance in pressure may cause one or more selectable strip radii 209 at selected positions on the fuser belt 203.

The process continues to step 607 in which the belt-roll fuser 200 causes one or more selectable strip radii 209 that are caused by actuating one or more of the adjustable blades 211 to exert one or more predetermined pressures on the fuser belt 203. As discussed above, the one or more predetermined pressures may be fixed or variable and controlled in consideration of any determined process variable discussed above.

Accordingly, the one or more selectable strip radii 209, as discussed above, may provide for customizable stripping performance for an inboard position, an outboard position, a lead edge, a trailing edge, a central position, or any selectable position across the width of the fuser belt 203 to optimize stripping performance.

Then, in step 609, the belt-roll fuser 200 strips the substrate from the fuser belt 203.

FIG. 7 illustrates a chip set or chip 700 upon which an embodiment of the invention may be implemented. Chip set 700 is programmed to control the one or more selectable strip radii as described herein and includes, for instance, a processor and memory components incorporated as one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 700 can be implemented in a single chip. It is further contemplated that in certain embodiments the chip set or chip 700 can be implemented as a single "system on a chip." It is further contemplated that in certain embodiments a separate ASIC would not be used, for example, and that all relevant functions as disclosed herein would be performed by a processor or processors. Chip set or chip 700, or a portion thereof, constitutes an example means for performing one or more steps of controlling the one or more selectable strip radii.

In one embodiment, the chip set or chip 700 includes a communication mechanism such as a bus 701 for passing information among the components of the chip set 700. A processor 703 has connectivity to the bus 701 to execute instructions and process information stored in, for example, a memory 705. The processor 703 may include one or more processing cores with each core configured to perform independently. A multi-core processor enables multiprocessing within a single physical package. Examples of a multi-core processor include two, four, eight, or greater numbers of processing cores. Alternatively or in addition, the processor 703 may include one or more microprocessors configured in tandem via the bus 701 to enable independent execution of instructions, pipelining, and multithreading. The processor 703 may also be accompanied with one or more specialized components to perform certain processing functions and tasks such as one or more digital signal processors (DSP) 707, or one or more application-specific integrated circuits (ASIC) 709. A DSP 707 typically is configured to process real-world signals (e.g., sound) in real time independently of the processor 703. Similarly, an ASIC 709 can be configured to perform specialized functions not easily performed by a more general purpose processor. Other specialized components to aid in performing the functions described herein may include one or more field programmable gate arrays (FPGA), one or more controllers, or one or more other special-purpose computer chips.

In one embodiment, the chip set or chip 700 includes merely one or more processors and some software and/or firmware supporting and/or relating to and/or for the one or more processors.

The processor 703 and accompanying components have connectivity to the memory 705 via the bus 701. The memory 705 includes both dynamic memory (e.g., RAM, magnetic disk, writable optical disk, etc.) and static memory (e.g., ROM, CD-ROM, etc.) for storing executable instructions that when executed perform the steps described herein to control the one or more selectable strip radii. The memory 705 also stores any data associated with or generated by the execution of the steps discussed herein.

While the above apparatuses, methods and systems for controlling nip geometry are described in relationship to exemplary embodiments, many alternatives, modifications, and variations would be apparent to those skilled in the art. Accordingly, embodiments of apparatuses, methods and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An apparatus useful in printing comprising:

a first member having a first surface;

a belt having a first portion that contacts the first surface of the first member;

a second member having a second surface that contacts a second portion of the belt in a region defining a nip;

a stripping apparatus, positioned downstream of the nip in a process direction, comprising two or more adjustable blades configured to selectively exert two or more variable predetermined pressures on one or more selected sections of the first portion of the belt causing one or more selectable strip radii, wherein the two or more variable predetermined pressures are controlled, at least in part, by selectively actuating one or more of the two or more adjustable blades; and two or more fulcrum systems comprising one or more components, wherein a degree of depression of the two or more blades that causes the two or more variable predetermined pressures is further controlled, at least in part, by a movement of the one or more components of at least two of the two or more fulcrum systems and the two or more variable predetermined pressures are further controlled based, at least in part, on a determination of two or more material types of the one or more components of the two or more fulcrum systems.

2. The apparatus of claim 1, wherein the two or more variable predetermined pressures are further controlled based, at least in part, on a determination of two or more materials of the two or more adjustable blades.

3. The apparatus of claim 2, wherein at least one adjustable blade of the two or more adjustable blades comprises a different material than another blade of the two or more adjustable blades.

4. The apparatus of claim 1, wherein the two or more variable predetermined pressures are further controlled based, at least in part, on a determination of two or more geometries of the two or more.

5. The apparatus of claim 1, wherein the two or more variable predetermined pressures are further controlled based, at least in part, on a determination of two or more geometries of the one or more components of the two or more fulcrum systems.

6. The apparatus of claim 1, wherein at least one fulcrum system of the two or more fulcrum systems comprises one or more components that are comprised of one or more different materials than one or more components of another fulcrum system of the two or more fulcrum systems.

7. The apparatus of claim 1, wherein the one or more selectable strip radii are selectively caused to change based on a determination of one or more of a media type, a media geometry, a belt geometry, an image type, an image location, a process speed, and a process timing.

8. A method for stripping a substrate in a printing process comprising:

defining a nip in an apparatus useful in printing, the apparatus comprising:

a first member having a first surface;

a belt having a first portion that contacts the first surface of the first member;

a second member having a second surface that contacts a second portion of the belt in a region defining a nip; and a stripping apparatus, positioned downstream of the nip in a process direction, comprising two or more adjustable blades configured to selectively exert two or more variable predetermined pressures on one or more selected sections of the first portion of the belt to cause one or more selectable strip radii;

causing, at least in part, the one or more selectable strip radii;

causing, at least in part, stripping of the substrate from the belt;

controlling the two or more variable predetermined pressures, at least in part, by selectively actuating one or more of the two or more adjustable blades;

wherein the apparatus further comprises two or more fulcrum systems comprising one or more components, the method further comprising:

controlling, at least in part, a degree of depression of the two or more blades that causes the two or more variable predetermined pressures by a movement of the one or more components of at least one of the two or more fulcrum systems controlling the two or more variable predetermined pressures based, at least in part, on a determination of two or more material types of the one or more components of the two or more fulcrum systems.

9. The method of claim 8, further comprising:

controlling the two or more variable predetermined pressures based, at least in part, on a determination of two or more materials of the two or more adjustable blades.

10. The apparatus of claim 8, wherein at least one adjustable blade of the two or more adjustable blades comprises a different material than another blade of the two or more adjustable blades.

11. The method of claim 8, further comprising:

controlling the two or more variable predetermined pressures based, at least in part, on a determination of two or more geometries of the two or more adjustable blades.

12. The method of claim 8, further comprising:

controlling the two or more variable predetermined pressures based, at least in part, on a determination of two or more geometries of the one or more components of the two or more fulcrum systems.

13. The method of claim 8, further comprising:

selectively causing the one or more selectable strip radii to change based on a determination of one or more of a media type, a media geometry, a belt geometry, an image type, an image location, a process speed, and a process timing.

* * * * *